US011982520B2

(12) United States Patent
Muller et al.

(10) Patent No.: US 11,982,520 B2
(45) Date of Patent: May 14, 2024

(54) WIRELESS DETONATOR SYSTEM

(71) Applicant: DETNET SOUTH AFRICA (PTY) LTD, Johannesburg (ZA)

(72) Inventors: Elmar Lennox Muller, Centurion (ZA); Marius Christo Botha, Johannesburg (ZA); Tielman Christiaan Meyer, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 64 days.

(21) Appl. No.: 17/793,801

(22) PCT Filed: Jan. 25, 2021

(86) PCT No.: PCT/ZA2021/050004
§ 371 (c)(1),
(2) Date: Jul. 19, 2022

(87) PCT Pub. No.: WO2021/159152
PCT Pub. Date: Aug. 12, 2021

(65) Prior Publication Data

US 2023/0057631 A1 Feb. 23, 2023

(30) Foreign Application Priority Data

Feb. 5, 2020 (ZA) ..... 2020/00740

(51) Int. Cl.
*F42D 1/055* (2006.01)
*F42D 3/04* (2006.01)

(52) U.S. Cl.
CPC ..... *F42D 1/055* (2013.01); *F42D 3/04* (2013.01)

(58) Field of Classification Search
CPC ..... F42D 1/045; F42D 1/05; F42D 1/055
See application file for complete search history.

(56) References Cited

U.S. PATENT DOCUMENTS

2008/0156217 A1* 7/2008 Stewart ..... F42D 3/04 102/206
2016/0003599 A1* 1/2016 Hikone ..... F42C 13/04 102/202.5
2018/0231361 A1 8/2018 Wicks et al.
2019/0137249 A1* 5/2019 Tasaki ..... F42C 11/008

FOREIGN PATENT DOCUMENTS

OA 18901 A * 9/2019 ..... B65H 49/32
WO 2020037337 A1 2/2020
WO 2020263193 A1 12/2020

OTHER PUBLICATIONS

International Preliminary Report on Patentability for PCT/ZA2021/050004, international filing date of Jan. 25, 2021, date of completion Apr. 26, 2022, 11 pages.
International Search Report for PCT/ZA2021/050004, international filing date of Jan. 25, 2021, date of mailing Apr. 9, 2021, 3 pages.
Written Opinion for PCT/ZA2021/050004, international filing date of Jan. 25, 2021, date of mailing Apr. 9, 2021, 5 pages.

* cited by examiner

*Primary Examiner* — Bret Hayes
(74) *Attorney, Agent, or Firm* — CANTOR COLBURN LLP

(57) ABSTRACT

A wireless detonator system wherein a blast control unit communicates bidirectionally with at least one tagger and with detonators, prior to deployment thereof, using a NFC technique, and a transmitter/receiver assembly communicates with each detonator atan ultralow frequency.

8 Claims, 2 Drawing Sheets

WIRELESS DETONATOR SYSTEM

CROSS-REFERENCE TO RELATED APPLICATIONS

This application is a U.S. national stage application of International Application No. PCT/ZA2021/050004 entitled "WIRELESS DETONATOR SYSTEM", which has an international filing date of 25 Jan. 2021, and which claims priority to South African Patent Application No. 2020/00740, filed 5 Feb. 2020.

BACKGROUND OF THE INVENTION

This invention relates generally to a wireless detonator system and more particularly to data transfer and device management techniques applicable to that type of system.

SUMMARY OF THE INVENTION

The invention provides, in the first instance, a wireless detonator system which includes a blast control unit, at least one transmitter/receiver assembly which is associated with the blast control unit, a plurality of detonators, each detonator associated with a respective transmitter and a respective receiver, and a mobile tagger, wherein, in use, the transmitter in said transmitter/receiver assembly is configured to transmit information at an ultralow frequency to each receiver associated with a respective detonator, and wherein the tagger is configured to communicate in a bi-directional manner with the blast control unit and the transmitter/receiver assembly and, at least prior to deployment of each detonator, with the respective transmitter and receiver associated with the detonator, using near field communication.

The ultralow frequency communication from the transmitter in the assembly is preferably effected using a magnetic signal. Said frequency is preferably <4000 Hz.

The wireless detonator system may include a controller and the blast control unit may be placed in communication with the controller using a local area network.

The tagger may be capable of wireless communication with the controller e.g. using Wi-Fi or RF techniques and, preferably, using near field communication techniques.

The respective transmitter associated with each detonator may be configured to communicate, optionally bi-directionally, with the transmitter/receiver assembly, prior to deployment of the detonator, using near field communication techniques.

Preferably communication between the blast control unit and the transmitter/receiver assembly is established using a communication system such as the RS-485 system. This system has a simple bus wiring, can accommodate long cable lengths and is substantially immune to magnetic interference—features which make it useful for inclusion in the wireless blasting system.

Each detonator may include a respective initiation unit which is configured to engage in bi-directional communication with the transmitter and receiver associated with the detonator.

The invention further extends to a detonator which comprises a first section which includes an antenna, a transmitter and a receiver which are connectable to the antenna, a power supply, a switching device and a processor, and wherein, in response to an incident signal detected by the antenna, energy is drawn from the incident signal and, subject to the operation of the processor, is used to operate the switching device so that energy from the power supply is usable to power the transmitter and the receiver.

The detonator may comprise a second section which includes an electronic initiating device and an explosive material, and the battery, subject to the operation of the processor, may be used to operate the electronic initiating device.

The detonator may include a bi-directional communication link between the first section and the second section.

BRIEF DESCRIPTION OF THE DRAWINGS

The invention is further described by way of example with reference to the accompanying drawings in which.

DESCRIPTION OF PREFERRED EMBODIMENT

Figure 1:
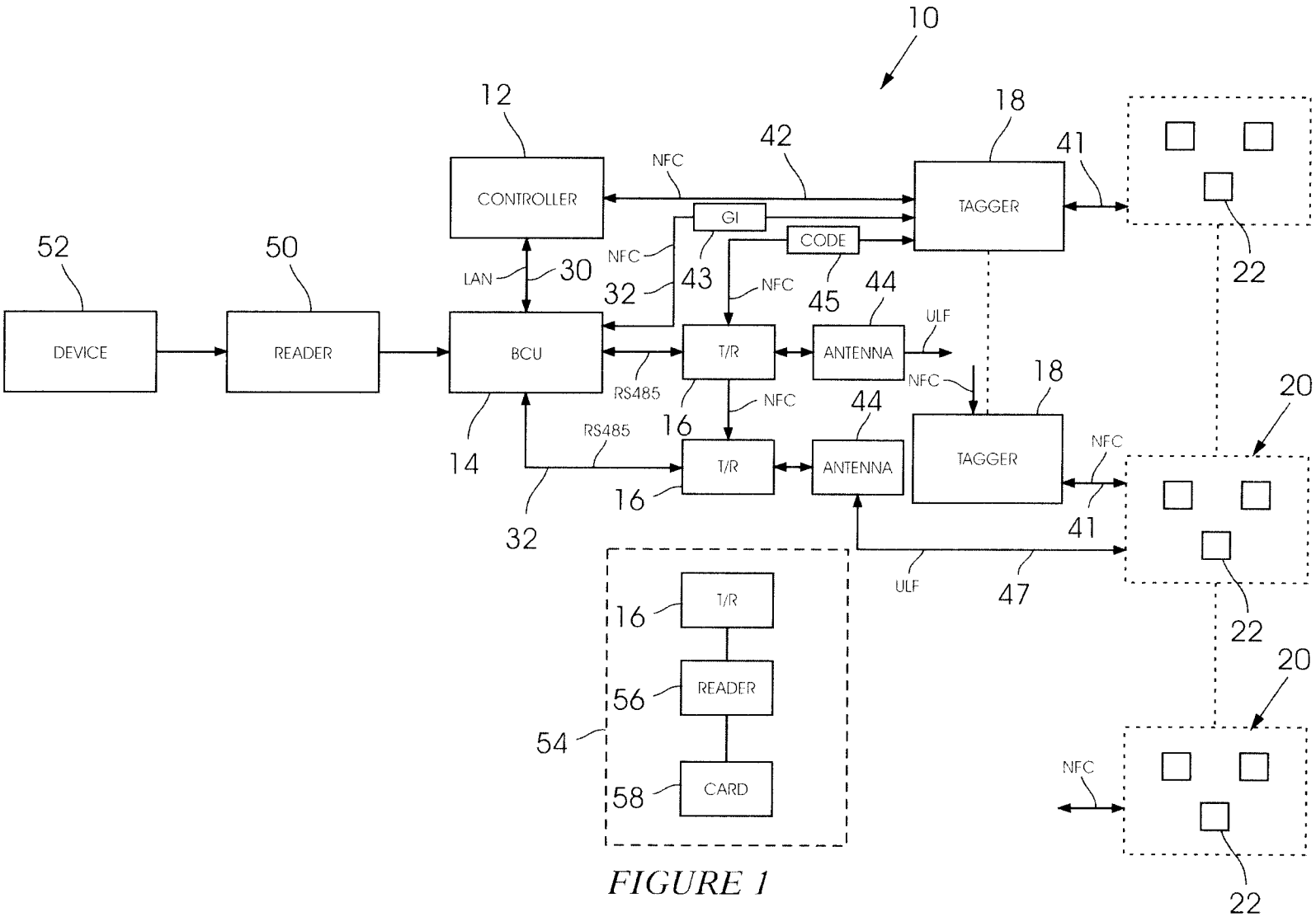
FIG. 1 is a block diagram representation of a wireless detonator system according to the invention.

FIG. 1 of the accompanying drawings illustrates in block diagram form a wireless detonator system 10 according to one form of the invention.

The system 10 includes a controller 12, a blast control unit 14, a transmitter/receiver assembly 16 which is associated with the blast control unit 14, at least one tagger 18 and at least one group 20 of a plurality of detonators 22.

The transmitter/receiver assembly 16 may be one of a number of similar assemblies. Similarly the tagger 18 may be one of a number of similar taggers.

The controller 12 is computer-based and typically includes a portable computer such as a laptop, a tablet, or the like. Similarly the blast controller unit 14 is portable.

The detonators 22 are positioned, as is known in the art, in boreholes (not shown) bored into rock. This aspect is conventional and not described. Each detonator 22 is associated with a respective receiver and a transmitter, described hereinafter with reference to FIG. 2.

Preferably the controller 12 is connected to the blast control unit 14 using a local area network 30. The blast control unit 14 is connected by means of a communication link 32 to the transmitter/receiver assembly 16. For ease of installation and reliability of operation the link 32 uses an RS-485 standard. This standard is well suited for use in a serial communication system. This communication protocol is exemplary only, and non-limiting.

Each tagger 18 can communicate using a near field communication (NFC) technique 41 with any detonator 22, and by using a near field communication technique 42 with the controller 12, the blast control unit 14 and each transmitter/receiver assembly 16. Such communication is bi-directional.

The detonators 22 can be arranged, as indicated, according to requirement, in specific groups 20. A signal originating from the controller 12, or from the blast control unit 14, which is intended for a specific group 20 of detonators can be restricted to that group using an appropriate group identifier technique 43.

Similarly, communication between a tagger 18 and a transmitter/receiver assembly 16 can be restricted using appropriate codes or identifiers 45.

Information from a transmitter/receiver assembly 16 to a group of detonators is transferred using an ultralow frequency (<4000 Hz) communication technique 47. This is preferably through the use of a magnetic field which can penetrate rock and generally, for this purpose, the transmitter (and depending on the system, the receiver) in an assembly 16 is connected to a respective relatively large loop antenna 44.

The blast control unit 14, each tagger 18, each transmitter/receiver assembly 16 and the transmitters and receivers associated with the respective detonators 22, each have a near field communication capability for reading and writing. This permits bi-directional data transfer between the devices.

The blast control unit 14 preferentially includes a near field communication (NFC) reader 50 which can read data on an encrypted card or other input device 52. This capability restricts the use of the blast control unit 14 to authorised personnel in possession of an appropriate card or device 52. As shown in a dotted block 54 a similar capability can be established for each transmitter/receiver assembly 16 through the use of a dedicated NFC reader 56 which can validate data on an encrypted card or device 58.

In an alternative approach a tagger 18 can be authorised for use only by at least one specific person. In that event the tagger 18 can be used in place of a card 52 to enable the identity of an operator of the tagger to be verified for operating the blast control unit 14. The identity of the operator can be established/verified using a suitable bio-parameter. The same technique can be used to replace the reader 56 which is associated with each transmitter/receiver assembly 16 i.e. a unit (not shown) coupled to the assembly 16 is used to verify the identity of the operator.

Prior to deployment of the various detonators 22 at least one tagger 18 is used to program each of the detonators 22 via the respective near field communication interface 41 available via the transmitter and receiver associated with the detonator. The taggers 18 may communicate with each other so that each tagger holds the same information.

Figure 2:
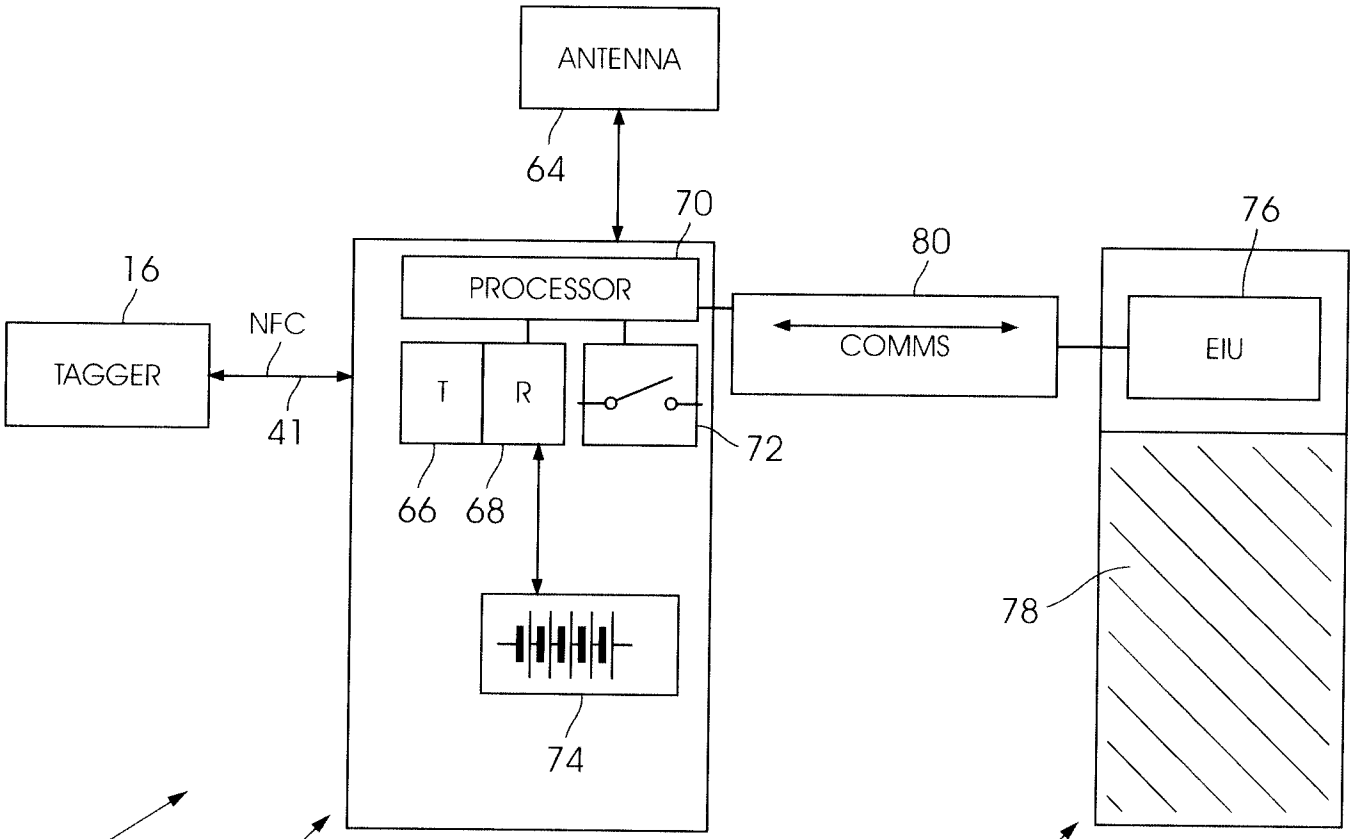
FIG. 2 depicts in block diagram form a detonator suitable for use in the wireless detonator system of FIG. 1.

FIG. 2 schematically illustrates a detonator 22. The detonator 22 includes a first section 60 and a second section 62.

The first section 60 includes an antenna structure 64, a transmitter 66 and a receiver 68 which are each connected to the antenna structure 64, a processor 70, an electrically operated switching device 72 and a battery 74. The antenna structure 64 comprises a first three-axis antenna tuned for low frequency communication and a second antenna which is used for NFC.

The second section 62 comprises an electronic initiating unit 76 and explosive material 78. Bi-directional communication between the first section 60 and the second section 62 is established by a bi-directional link 80. The unit 76 is powered via the link 80.

The switching device 72 is only closed when the detonator 22 is to be rendered operative. Up to then the detonator may be regarded as a passive device. If the antenna structure 64 detects a near field communication signal from a tagger 18 then energy is induced into the antenna structure 64 by the electromagnetic field. In a known way energy is extracted from the received signal under the control of the processor 70 which acts, in a broad respect, in the manner of a controlled power supply. That extracted energy is used by the processor 70 to close the switching device 72, and the battery 74 then provides energy to operate the transmitter 66 and the receiver 68 which, normally, are part of a custom-designed integrated circuit which includes a safety mechanism which prevents a high voltage (firing voltage) from being applied to the detonator until such time as the detonator 22 has been armed. The integrated circuit (not shown) may be a part of the processor 70 or vice versa. Thus, upon the detonator 22 receiving an NFC signal, the processor (or the integrated circuit) can switch the device 72 on, or wake the device 72 up from an ultralow-powered state. If the switching device 72 is closed in the manner described then the integrated circuit (and the processor) can function as active devices in that, with the increased quantity of energy available from the battery 74, the transmitter 66 and receiver 68 can transfer data faster. Also the transmitter 66 has an extended range and the receiver 68 is more sensitive.

When firing of the detonators is to take place a fire signal is generated by the blast control unit 14 under the operation of the controller 12. A corresponding signal is then sent via the RS-485 link to at least one of the transmitter/receiver assemblies 16. In response, in each case, a magnetic signal is generated and transmitted via the associated antenna 44. At each detonator 22, normally in a specific group 20 of detonators, the respective receivers 68 detect the magnetic signal and, after execution of a specific time delay previously programmed into each detonator through the use of the tagger 18, a firing signal is transmitted to the associated electronic initiation unit 76 via the bi-directional communication link 80 to fire the explosive material 78.

The invention claimed is:

1. A method of operating a wireless detonator system which includes a controller, a blast control unit, at least one transmitter/receiver assembly which is associated with the blast control unit, a mobile tagger and a plurality of detonators, each detonator comprising:

a first section which includes an antenna, an associated transmitter and an associated receiver which are connectable to the antenna, a power supply, a processor, and a switching device, and a second section which comprises an initiation device, wherein the method includes the steps of:

transmitting information at an ultralow frequency from the transmitter in the assembly to each receiver associated with a respective detonator, using the tagger to communicate in a bi-directional manner using a near field communication technique (i) with the blast control unit, (ii) with the transmitter/receiver assembly and, (iii) at least prior to deployment of each detonator, with the respective transmitter and receiver associated with the detonator, in response to an incident signal from said transmitter/receiver assembly detected by the antenna, drawing energy from the incident signal and, subject to the operation of the processor, using said drawn energy to operate the switching device so that energy from the power supply powers the associated transmitter and the associated receiver.

2. A method according to claim 1 which includes the step of using a magnetic signal to effect the ultralow frequency communication from the transmitter in the assembly.

3. A method according to claim 1 which includes the step of using a local area network to place the blast control unit in communication with the controller.

4. A method according to claim 1 which includes the step of establishing communication between the tagger and the controller using Wi-Fi, RF or near field communication techniques.

5. A method according to claim 1 which includes the step, prior to deployment of a detonator, of causing the transmitter associated with the detonator to engage in unidirectional communication or bi-directional communication with the transmitter/receiver assembly by using a near field communication technique.

6. A method according to claim 1 which includes the step of using an RS-485 communication system to establish communication between the blast control unit and the transmitter/receiver assembly.

7. A method according to claim 1 which includes the step, for each detonator, of establishing bi-directional communication between the initiation device and the transmitter and receiver associated with the detonator.

8. A method according to claim 1 which includes the step for each detonator of using the power supply, subject to the operation of the processor, to operate the initiating device.

* * * * *